US010166415B2

(12) United States Patent
Tekelenburg et al.

(10) Patent No.: US 10,166,415 B2
(45) Date of Patent: Jan. 1, 2019

(54) BREATHING APPARATUS WITH TANK ALIGNMENT SYSTEM

(71) Applicant: MSA TECHNOLOGY, LLC, Cranberry Township, PA (US)

(72) Inventors: Marco Tekelenburg, Zelienople, PA (US); David J. Losos, Evans City, PA (US); Bryan J. Peoples, Baden, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 643 days.

(21) Appl. No.: 14/144,310

(22) Filed: Dec. 30, 2013

(65) Prior Publication Data

US 2015/0151146 A1 Jun. 4, 2015

Related U.S. Application Data

(60) Provisional application No. 61/910,181, filed on Nov. 29, 2013.

(51) Int. Cl.

| | |
|---|---|
| ***A62B 9/04*** | (2006.01) |
| ***A62B 25/00*** | (2006.01) |
| *A62B 7/02* | (2006.01) |

(52) U.S. Cl.

CPC ..... *A62B 9/04* (2013.01); *A62B 25/00* (2013.01); *A62B 7/02* (2013.01); *Y10T 29/49826* (2015.01)

(58) Field of Classification Search

CPC ..... A62C 13/78; F17C 13/084; B60R 11/00; B60R 2011/0015; B60N 2/24; B63C 2011/2281; B63C 11/22; B63C 2011/024; B63C 2011/025; B63C 2011/026; A62B 7/02; A62B 25/005; A62B 25/00; A62B 9/04

USPC ..... 224/582; 248/311.3

See application file for complete search history.

(56) References Cited

U.S. PATENT DOCUMENTS

| | | | |
|---|---|---|---|
| 4,821,767 | A | 4/1989 | Jackson |
| 5,016,627 | A | 5/1991 | Dahrendorf |
| 6,198,396 | B1 | 3/2001 | Frank |

(Continued)

FOREIGN PATENT DOCUMENTS

| | | |
|---|---|---|
| WO | WO2015081043 | 6/2015 |

*Primary Examiner* — Nathan J Newhouse
*Assistant Examiner* — Matthew Theis
(74) *Attorney, Agent, or Firm* — Bartony & Associates, LLC

(57) ABSTRACT

A system includes a carrier system adapted to be worn by a user and to support at least one of a plurality of differently sized tanks of breathing gas, a bracket connector attached to the carrier system, and a plurality of brackets. The carrier system may, for example, be part of a breathing apparatus such as a self-contained breathing apparatus. Each of the plurality of brackets has a different configuration. Each of the plurality of brackets is attachable to an associated one of the plurality of differently sized tanks and to the bracket connector. For each one of the plurality of brackets, an assembly that includes the one of the plurality of brackets and the associated one of the plurality of differently sized tanks, when attached to the bracket connector, positions the associated one of the plurality of differently sized tanks in a predetermined manner relative to the carrier system.

18 Claims, 11 Drawing Sheets

(56) References Cited

U.S. PATENT DOCUMENTS

| | | | | |
|---|---|---|---|---|
| 6,920,879 | B2 * | 7/2005 | Haeuser | A62B 9/04<br>128/201.27 |
| 7,658,190 | B1 * | 2/2010 | Phifer | A62B 7/10<br>128/201.25 |
| 8,256,420 | B2 | 9/2012 | Prete | |
| 2005/0103959 | A1 * | 5/2005 | Lee | B63C 11/18<br>248/223.41 |
| 2006/0175492 | A1 * | 8/2006 | Cooper | A62B 9/04<br>248/229.17 |
| 2007/0175470 | A1 * | 8/2007 | Brookman | A62B 25/00<br>128/200.23 |
| 2008/0257928 | A1 * | 10/2008 | Lowry | A45F 3/04<br>224/638 |
| 2011/0030309 | A1 * | 2/2011 | Peacock | E04G 15/061<br>52/745.2 |
| 2012/0152253 | A1 | 6/2012 | Leuschner | |
| 2012/0160245 | A1 | 6/2012 | Leuschner | |

* cited by examiner

BREATHING APPARATUS WITH TANK ALIGNMENT SYSTEM

CROSS-REFERENCE TO RELATED APPLICATIONS

This application claims benefit of U.S. Provisional Patent Application Ser. No. 61/910,181, filed Nov. 29, 2013, the disclosure of which is incorporated herein by reference.

BACKGROUND

The following information is provided to assist the reader in understanding technologies disclosed below and the environment in which such technologies may typically be used. The terms used herein are not intended to be limited to any particular narrow interpretation unless clearly stated otherwise in this document. References set forth herein may facilitate understanding of the technologies or the background thereof. The disclosure of all references cited herein are incorporated by reference.

A self-contained breathing apparatus ("SCBA") is a device used to enable breathing in environments which are immediately dangerous to life and health (sometimes referred to as "IDLH" environments). For example, firefighters wear an SCBA when fighting a fire. The SCBA typically has a harness or carrier system including a backplate supporting an air tank or cylinder which is connected to a user interface such as a mouthpiece or a facepiece, all of which are worn or carried by the user. The tank typically contains air or oxygen-containing breathing gas under high pressure (for example, 2200-5500 psi or 15,168 to 37921 kPa) and is connected to a first stage regulator which reduces the pressure to about 80-100 psi or 552 to 689 kPa. The SCBA usually has a second stage regulator that has an inlet valve which controls the flow of air for breathing between the air tank and the facepiece. Typically, the inlet valve controls the flow of air through the second stage regulator in response to the respiration of the user. Such respiration-controlled regulator assemblies are disclosed, for example, in U.S. Pat. Nos. 4,821,767 and 5,016,627, the disclosures of which are incorporated herein by reference.

Currently available SCBAs and other breathing apparatuses include multiple fastening components to position and attach pneumatic and/or electronic components (for example, connectors, hoses, cables etc.) to the backplate. Accessing multiple fastening components impedes the assembly and removal of pneumatic and/or electronic components. Moreover, pneumatic and/or electronic components and their associated connections are left substantially unprotected or underprotected in some currently available systems. As a result, the pneumatic and/or electronic components and connections may be subject to significant impact and environmental exposure. Often, materials for pneumatic and/or electronic components and their associated connections must be selected to endure substantial environmental exposure and impacts, adding cost and weight to the breathing apparatus.

Problems also arise in currently available breathing apparatuses as a result of differently sized tanks. For example, making a connection between the tank/cylinder valve outlet and the first stage regulator is difficult because the distance therebetween changes with differently sized tanks. The variable distance may, for example, require the use of different high-pressure hose assemblies having different lengths and/or configurations. A number of breathing apparatuses include a first stage regulator assembly that is variable in position (for example, sliding or floating) to adjust the distance between the outlet of the tank valve and the connector for the first stage regulator. Such an approach requires the first stage regulator assembly to move up and down and/or forward and back to connect to different diameter tanks. Hoses exiting the first stage regulator (for example, a second stage regulator hose and/or a gauge hose) in such systems must be able to move relative to the backplate and/or shoulder straps. Moving the hoses varies effective hose length and/or configuration, which may adversely impact user interfaces. Moreover, a movable first stage regulator assembly may not be suitably structurally supported, and clearance space must be provided to accommodate motion of the movable first stage regulator assembly.

A number of breathing apparatuses use a tank/cylinder connection that articulates to accommodate different size tanks. Such systems require that the connection include multiple components and high pressure seals to allow the tank connection to be positioned properly relative to different size tanks. The additional components and seals increase design complexity and cost, while introducing additional high-pressure seal leakage risks. An articulating tank connection may further hinder the user's ability to properly position and engage the cylinder valve.

Various abutment geometries may be used to contact the tank to position the tank relative to the backplate. However, the geometries of tanks vary significantly (for example, as a result of different pressure ratings, construction materials, and manufacturing processes). The variability in tank geometries makes it very difficult to appropriately control the position of tanks via abutments or stops.

The variability in tank size and geometry also affects the connection of the tank to the backplate and the orientation of the tank relative to the backplate. Widely varying tank geometry and size may, for example, cause the tank to be angled relative to the backplate and result in an increased profile (thereby increasing the likelihood of catching or entanglement in confined spaces). Currently available connectors and/or abutments used to position tanks have limited success because of the variability in tank geometries discussed above.

SUMMARY

In one aspect, a system, includes a carrier system adapted to be worn by a user and to support at least one of a plurality of differently sized tanks of breathing gas, a bracket connector attached to the carrier system, and a plurality of brackets. The carrier system may, for example, be part of a breathing apparatus such as a self-contained breathing apparatus. Each of the plurality of brackets has a different configuration. Each of the plurality of brackets is attachable to an associated one of the plurality of differently sized tanks and to the bracket connector. For each one of the plurality of brackets, an assembly that includes the one of the plurality of brackets and the associated one of the plurality of differently sized tanks, when attached to the bracket connector, positions the associated one of the plurality of differently sized tanks in a predetermined manner relative to the carrier system.

In a number of embodiments, the carrier system includes a rigid backplate, and the associated one of the plurality of differently sized tanks of the assembly is positioned at a predetermined angle relative to the rigid backplate when the assembly is attached to the bracket connector. The associated one of the plurality of differently sized tanks of the assembly may, for example, be positioned generally parallel to a portion of the rigid backplate regardless of which of the plurality of differently sized tanks is connected to the assembly when the assembly is attached to the bracket connector.

In a number of embodiments, a tank valve outlet of a tank valve of the one of the plurality of differently sized tanks of the assembly is positioned at a predetermined rearward position relative to the carrier system and at a predetermined height relative to the carrier system when the assembly is attached to the bracket connector. The predetermined rearward position of the tank valve outlet relative to the carrier system and the predetermined height of the of the tank valve outlet relative to the carrier system may, for example, coincide generally with a predetermined arc for each of the plurality of differently sized tanks. In a number of embodiments, the bracket connector is a dovetailed connector and each one of the plurality of brackets comprises a cooperating dovetailed connector.

The system may, for example, further include at least one pressure regulator attached to the carrier system and a connector attached (either directly or indirectly) to the carrier system which is in fluid connection with the at least one pressure regulator. In a number of embodiment, for each one of the plurality of brackets, an assembly including the one of the plurality of brackets and the associated one of the plurality of differently sized tanks, when attached to the bracket connector, positions the associated one of the plurality of different sized tanks of the assembly so that a distance between the tank valve outlet of the associated one of the plurality of differently sized tanks and the connector varies by less than a predetermined distance. The predetermined distance is the same for each one of the plurality of differently sized tanks. The predetermined distance may, for example, be less than 0.5 inches, less than 0.25 inches or less than 0.1 inches. The system may, for example, further include a hose assembly having a fixed length and including a cooperating connector adapted to attach to the connector and a tank valve connector adapted to attach to the tank valve outlet to place the tank valve outlet in fluid connection with the at least one pressure regulator regardless of which one of the plurality of differently sized tanks is connected to the assembly when the assembly is attached to the bracket connector. The carrier system may, for example, include a rigid back plate to which the at least one pressure regulator, the connector and the bracket connector are attached. The associated one of the plurality of differently sized tanks of the assembly may, for example, be generally parallel to a portion of the rigid back plate regardless of which of the plurality of differently sized tanks is connected to the assembly when the assembly is attached to the bracket connector. Each of the plurality of differently sized tanks of the assembly may, for example, be generally cylindrical over a portion of the length thereof.

In a number of embodiments, each one of the plurality of brackets includes a first section and a second section that is removably attachable to the first section. Each one of the plurality of brackets may, for example, be attachable to the associated one of the plurality of differently sized tanks by attaching the first section to the second section to capture a portion of the associated one of the plurality of differently sized tanks so that the tank valve extends between the first section and the second section.

In a number of embodiments, the carrier system further includes an arced cradle to contact the associated one of the differently sized tanks and a tank strap to extend around a portion of the associated one of the differently sized tanks. The associated one of the plurality of differently sized tanks of the assembly may, for example, be positioned generally parallel to a general orientation of the cradle regardless of which of the plurality of differently sized tanks is connected to the assembly when the assembly is attached to the bracket connector.

In a number of embodiments, the system further includes at least one pressure regulator attached to the carrier system and a cover system releasably attachable to the carrier system. The cover system encompasses at least a portion of a pneumatic hose in fluid connection with the pressure regulator. The carrier system may, for example, further include an electronics system including at least one electronic cable. The cover system may encompass at least a portion of the at least one electronic cable. In a number of embodiments, the cover system includes an outer cover releasably attachable to the carrier system, and the electronics system includes an electronics module housing from which a plurality of electronic cables extend, the outer cover encompassing at least a portion of each of the plurality of electronic cables when the outer cover is releasably attached to the carrier system.

The carrier system may further include a plurality of inner covers adapted to be placed in operative connection with the carrier system to encompass one or more components thereof. The outer cover may be adapted to be placed rearward of the plurality of inner covers and to interact with the plurality of inner covers to releasably connect the plurality of inner covers to the carrier system when the outer cover is releasably attached to the carrier system. The carrier system may, for example, further include a plurality of electronics covers adapted to be placed in operative connection with the electronics assembly housing. The outer cover may, for example, be adapted to be placed rearward of the plurality electronics covers and to interact with the plurality of electronics covers to releasably connect the plurality of electronics covers to the carrier system when the outer cover is releasably attached to the carrier system.

In a number of embodiments, the outer cover retains at least one pneumatic hose and each of the plurality of electronic cables of the system between the outer cover and a rigid backplate of the carrier system.

In a number of embodiments, the bracket connector is attached to a rearward surface of the outer connector.

In a number of embodiments, the carrier system includes a rigid backplate, and the system further includes at least one pressure regulator attached to a lower portion of the rigid backplate, at least one electronics assembly housing attached to the rigid backplate adjacent to the at least one pressure regulator, and an outer cover releasably attachable to the rigid backplate. The outer cover encompasses at least a portion of a length a pneumatic hose extending from pressure regulator and at least a portion of a length of at least one electronic cable extending from the at least one electronics assembly housing when the outer cover is releasably attached to the carrier system. The outer cover may, for example, encompass at least a portion of the at least one pressure regulator and at least a portion of the electronics assembly housing when the outer cover is releasably attached to the carrier system. The outer cover may, for example, be generally centrally positioned relative to the rigid back plate when the outer cover is releasably attached to the carrier system.

In another aspect, a method of providing for attachment of a one of a plurality of differently sized tanks of breathing gas to a carrier system to be worn by a user includes providing a plurality of brackets, each of the plurality of brackets having a different configuration, each of the plurality of brackets being attachable to an associated one of the plurality of differently sized tanks and to the carrier system, wherein, for each one of the plurality of brackets, an assembly including the one of the plurality of brackets and the associated one of the plurality of differently sized tanks, when attached to carrier system, positions the associated one of the plurality of differently sized tanks in a predetermined position relative to the carrier system.

The carrier system may, for example, include a rigid backplate and the associated one of the plurality of differently sized tanks of the assembly is positioned at a predetermined angle relative to the rigid backplate when the assembly is attached to the bracket connector. The associated one of the plurality of differently sized tanks of the assembly may, for example, be positioned generally parallel to a portion of the rigid backplate regardless of which of the plurality of differently sized tanks is connected to the assembly when the assembly is attached to the bracket connector.

In a number of embodiments, a tank valve outlet of a tank valve of the associated one of the plurality of differently sized tanks of the assembly is positioned at a predetermined rearward position relative to the carrier system and at a predetermined height relative to the carrier system when the assembly is attached to the bracket connector. The predetermined rearward position of the tank valve outlet relative to the carrier system and the predetermined height of the of the tank valve outlet relative to the carrier system may, for example, coincide generally with a predetermined arc for each of the plurality of differently sized tanks. In a number of embodiments, the bracket connector is a dovetailed connector, and each one of the plurality of brackets comprises a cooperating dovetailed connector.

In a number of embodiments, at least one pressure regulator is attached to the carrier system and a connector is attached to the carrier system which is in fluid connection with the at least one pressure regulator, wherein, for each one of the plurality of brackets, an assembly including the one of the plurality of brackets and the associated one of the plurality of differently sized tanks, when attached to the bracket connector, positions the associated one of the plurality of different sized tanks of the assembly so that a distance between the tank valve outlet of the associated one of the plurality of differently sized tanks and the connector varies by less than a predetermined distance. The predetermined distance is the same for each one of the plurality of differently sized tanks. The predetermined distance may, for example, be less than 0.5 inches, less than 0.25 inches or less than 0.1 inches.

In a number of embodiments, a hose assembly having a fixed length and including a cooperating connector adapted to attach to the connector and a tank valve connector adapted to attach to the tank valve outlet to place the tank valve outlet in fluid connection with the at least one pressure regulator is attachable to the connector and to the tank valve outlet regardless of which one of the plurality of differently sized tanks is connected to the assembly when the assembly is attached to the bracket connector.

In another aspect, a breathing system, includes a carrier system to be worn by a user and adapted to have a tank of breathing gas attached thereto, at least one pressure regulator attached to the carrier system and a cover system releasably attachable to the carrier system. The cover system encompasses at least a portion of a length of a pneumatic hose in fluid connection with the pressure regulator. The carrier system may further include an electronics system including at least one electronic cable. The cover system encompasses at least a portion of a length of the at least one electronic cabling.

The cover system may, for example, include an outer cover releasably attachable to the carrier system and the electronics system may include an electronics module housing from which a plurality of electronic cables extend. The outer cover may encompass at least a portion of a length of each of the plurality of electronic cables when the outer cover is releasably attached to the carrier system. In a number of embodiments, the system further includes a plurality of inner covers adapted to be placed in operative connection with the carrier system to encompass one or more components thereof. The outer cover may, for example, be adapted to be placed rearward of the plurality of inner covers and to interact with the plurality of inner covers to releasably connect the plurality of inner covers to the carrier system when the outer cover is releasably attached to the carrier system. The system may, for example, include a plurality of electronics covers adapted to be placed in operative connection with the electronics assembly housing. The outer cover may, for example, be adapted to be placed rearward of the plurality of plurality of electronics covers and to interact with the plurality of electronics covers to releasably connect the plurality of electronics covers to the carrier system when the outer cover is releasably attached to the carrier system.

In a number of embodiments, the outer cover retains at least one pneumatic hose and each of a plurality of electronic cables between the outer cover and a rigid backplate of the carrier system. In a number of embodiments, outer cover comprises a connector adapted to attach the tank thereto.

In a number of embodiments, the carrier system comprises a rigid backplate, and the at least one pressure regulator of the system is attached to a lower portion of the rigid backplate. The system may further include at least one electronics assembly housing attached to the rigid backplate adjacent to the at least one pressure regulator. The cover system may, for example, include an outer cover releasably attachable to the rigid backplate. The outer cover may encompass at least a portion of a length a pneumatic hose extending from pressure regulator and at least a portion of a length of at least one electronic cable extending from the at least one electronics assembly housing when the outer cover is releasably attached to the carrier system. The outer cover may, for example, encompass at least a portion of the at least one pressure regulator and at least a portion of the electronics assembly housing when the outer cover is releasably attached to the carrier system. The outer cover may, for example, be generally centrally positioned relative to the rigid backplate when the outer cover is releasably attached to the carrier system. The outer cover may, for example, further encompass at least one of a pneumatic connector or an electronic connector.

In a further aspect, a method includes providing a carrier system to be worn by a user and adapted to have a tank of breathing gas attached thereto. At least one pressure regulator is attached to the carrier system. The method further includes providing a cover system releasably attachable to the carrier system. The cover system encompasses at least a portion of a length of a pneumatic hose in fluid connection with the pressure regulator when the cover system is releasably attached to the carrier system. In a number of embodiments, an electronics system including at least one electronic cable is attached to the carrier system. The cover system may, for example, encompass at least a portion of a length of the at least one electronic cabling when the cover system is releasably attached to the carrier system.

In still a further aspect, method of protecting and retaining at least one electronic cable and at least one pneumatic hose in operative connection with a carrier system of a breathing apparatus includes providing a cover system releasably attachable to the carrier system. The cover system encompasses at least a portion of a length of the at least one pneumatic hose and at least a portion of a length of the at least one electronic cable when the cover system is releasably attached to the carrier system.

The present devices, systems, and methods, along with the attributes and attendant advantages thereof, will best be appreciated and understood in view of the following detailed description taken in conjunction with the accompanying drawings.

DETAILED DESCRIPTION

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As used herein and in the appended claims, the singular forms "a," "an", and "the" include plural references unless the context clearly dictates otherwise. Thus, for example, reference to "a light source" includes a plurality of such light sources and equivalents thereof known to those skilled in the art, and so forth, and reference to "the light source" is a reference to one or more such light sources and equivalents thereof known to those skilled in the art, and so forth. Recitation of ranges of values herein are merely intended to serve as a shorthand method of referring individually to each separate value falling within the range. Unless otherwise indicated herein, each separate value and all intermediate ranges are incorporated into the specification as if individually recited herein. All methods described herein can be performed in any suitable order unless otherwise indicated herein or otherwise clearly contraindicated by the text.

Figure 1A:
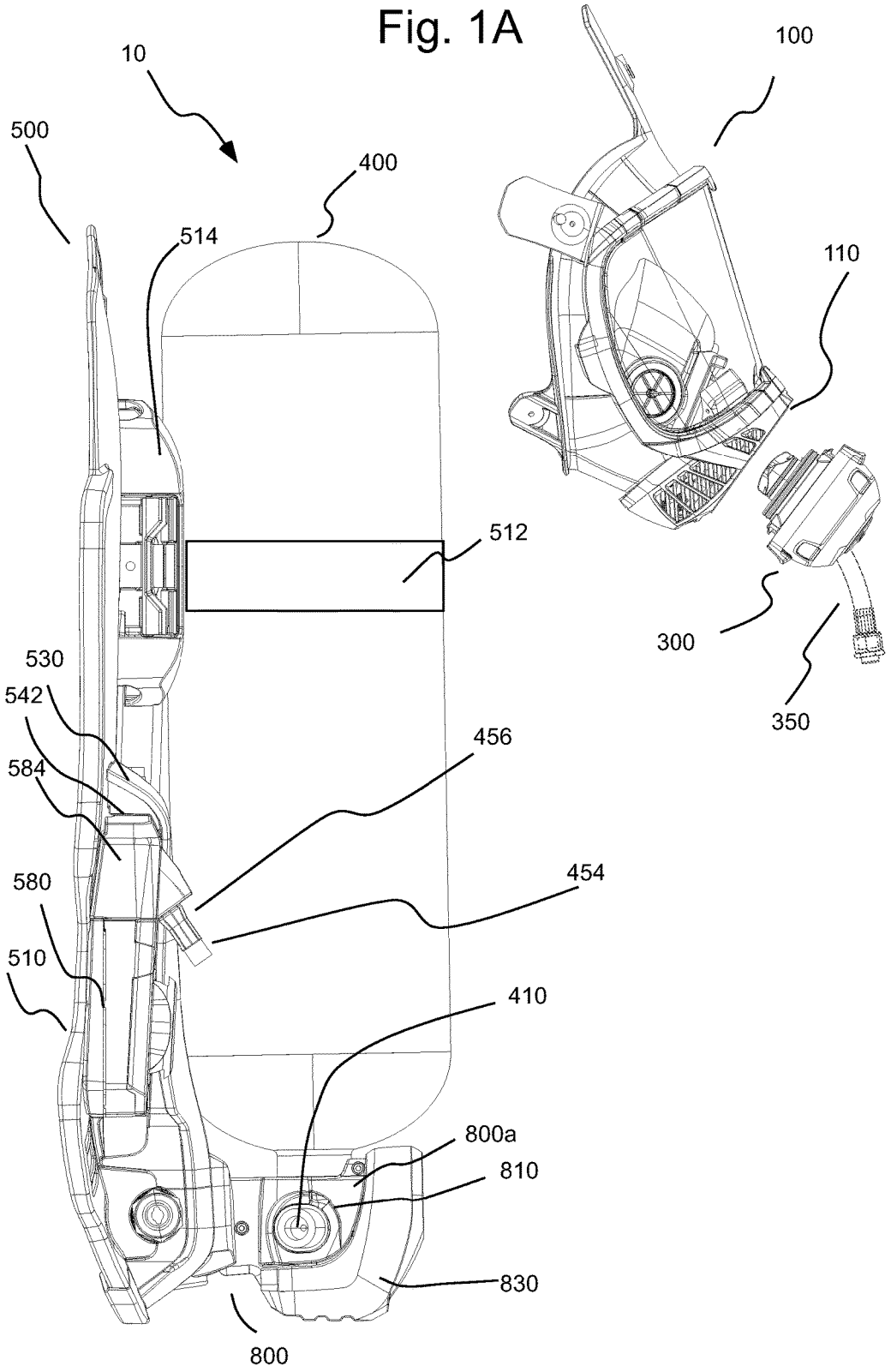
FIG. 1A illustrates a side view of an embodiment of a self-contained breathing apparatus (SCBA) hereof showing a tank in operative connection with the backplate of the carrier system of the SCBA.

In general, terms of relative position or direction such as upper, lower, forward, rearward, height, depth, width and the like, as used herein, refer to a position or direction relative to a user when standing upright and wearing system 10 in the general orientation illustrated in FIG. 1A.

FIG. 1A illustrates an embodiment of a breathing system 10 hereof such as an SCBA. In the illustrated embodiment, breathing system 10 includes a user interface via which breathing gas is delivered to the user such as a mouthpiece or a facepiece 100 to be worn by a user. Facepiece 100 forms a sealed volume surrounding the nose and mouth of the user into which breathing gas in introduced. In that regard, facepiece 100 includes a regulator interface portion 110 to place facepiece 100 in fluid connection with a second stage pressure regulator assembly 300 so that pressurized air can be supplied from a pressurized air tank such as tank 400 via high-pressure hosing 350 (see FIGS. 1 and 4). FIGS. 1A through 7B illustrate an embodiment of a carrier system 500 including a retention system and associated methodology via which one of differently sized tanks 400, 400' or 400" can be attached to backplate 510 of carrier system 500. Various aspects of system 10 are described herein with reference to tank 400 attached to backplate 510 as a representative example.

Facepieces suitable for use in breathing system 10 are described, for example, in U.S. Patent Application Publication Nos. 2012/0160245 and 2012/0152253, and U.S. Pat. No. 8,256,420, the disclosures of which are incorporated herein by reference. Likewise, a second stage pressure regulator suitable for use in connection therewith is described, for example, in U.S. Patent Application Publication No. 2012/0160245 and 2012/0152253, and U.S. Pat. No. 8,256,420.

Pressurized air tank or cylinder 400 (or another tank) is supported on and strapped to a harness or carrier system 500 which is worn by the user of system 10. In the illustrated embodiment, carrier system 500 includes a rigid backplate 510 to support (among other components of SCBA 10) tank 400 and strapping (for example, including shoulder straps and a waist belt which are not shown) to connect backplate 510 to the user. An adjustable tank strap 512 (for example, a metal strap) assists in retaining tank 400 in connection with an arced cradle 514 formed on or attached to backplate 510. A valve 410 of tank 400 provides air from pressurized tank 400 to a connector 520 (see, for example, FIG. 3B) attached to backplate 510. Connector 520 is in fluid connection with a first stage regulator assembly 700 via a connector 520*a* and a connector 710 of first stage regulator assembly 700 (see, for example, FIG. 4). As described above, tank 400 may, for example, contain air or oxygen-containing breathing gas under high pressure (for example, in the range of 2200-5500 psi or 15,168 to 37921 kPa). First stage regulator assembly 700, which is attached to backplate 510, reduces the pressure to, for example, about 80-100 psi (552 to 689 kPa). Breathing gas leaves first stage regulator 700 via a connector 720 and flows to inlet (not shown) of second stage regulator 300 via high pressure hosing 350 (a portion of which is shown FIG. 1).

FIGS. 1A through 2B, for example, illustrates a tank retention system including a plurality of tank brackets of various configuration which are attachable to tanks of varied size and/or geometry to form an assembly which is attached to carrier system 500. An associated, unique tank bracket may, for example, be provided for each tank size/geometry which is designed or configured specifically for that tank/geometry. Upon attachment of a tank bracket with the associated tank to form an assembly as described above, the tank bracket cooperates with a bracket connector of carrier system 500 to position the tank at a predetermined angle relative to the carrier system and/or at a predetermined position relative to carrier system 500.

In a number of embodiments, tanks of various size and/or geometry are each maintained in a generally parallel contacting engagement with at least a portion of carrier system 500 or backplate 510 thereof. For example, a longitudinal axis or plane of each tank (which may be generally cylindrical over at least a portion thereof) may be maintained generally parallel (for example, within no more than 5 degrees of parallel or within no more than 2.5 degrees of parallel) to axially extending cradle 514 or to a generally linear portion of backplate 510. In general, it is desirable in a number of embodiments to maintain the axis of the tank generally parallel to the orientation of the user's back. Thus, if the user's back (or the frontal or coronal plane) is generally vertical (that is, generally aligned with the direction of the gravitational force at the point the user is standing), the axis of the tank is maintained in a generally vertical orientation. In a number of embodiments, tanks of various size and/or geometry are positioned relative to carrier system 500 so that a distance between connector 520 (or another point on carrier system 500) and the tank valve outlet (or another point on the tank) is maintained substantially constant for each tank regardless of varying tank size and/or geometry. Maintaining such a fixed distance for each of a plurality of tanks of varying size, dimensions and/or geometry enables, for example, use of a single hose assembly 450 of fixed length in connection with each of the plurality of tanks of varying size and/or geometry.

Figure 1B:
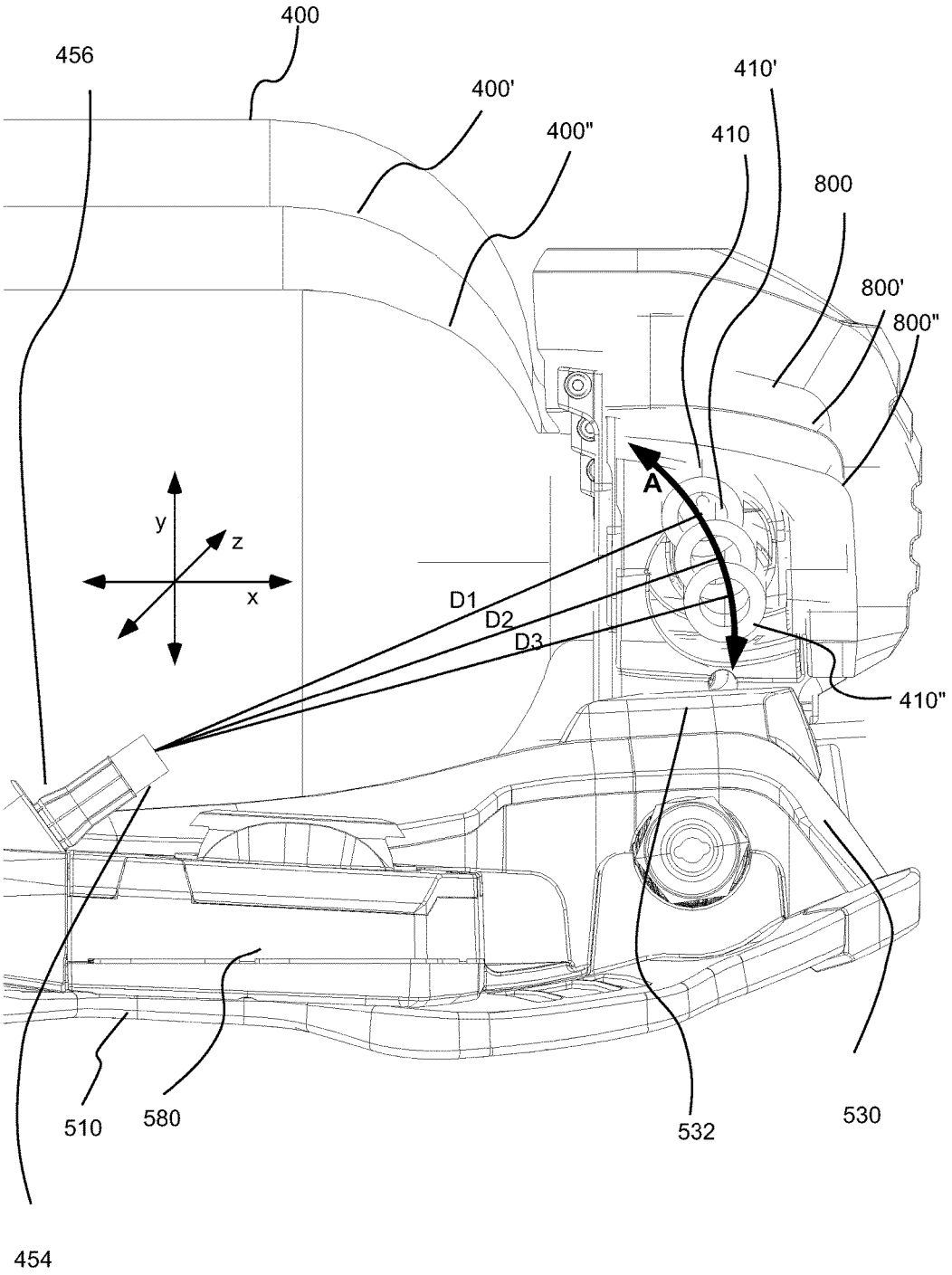
FIG. 1B illustrates an enlarged side view of a lower portion of the self-contained breathing apparatus of FIG. 1A showing three differently sized tanks and three associated tank brackets used to position the tanks on and relative to the backplate.
Figure 1C:
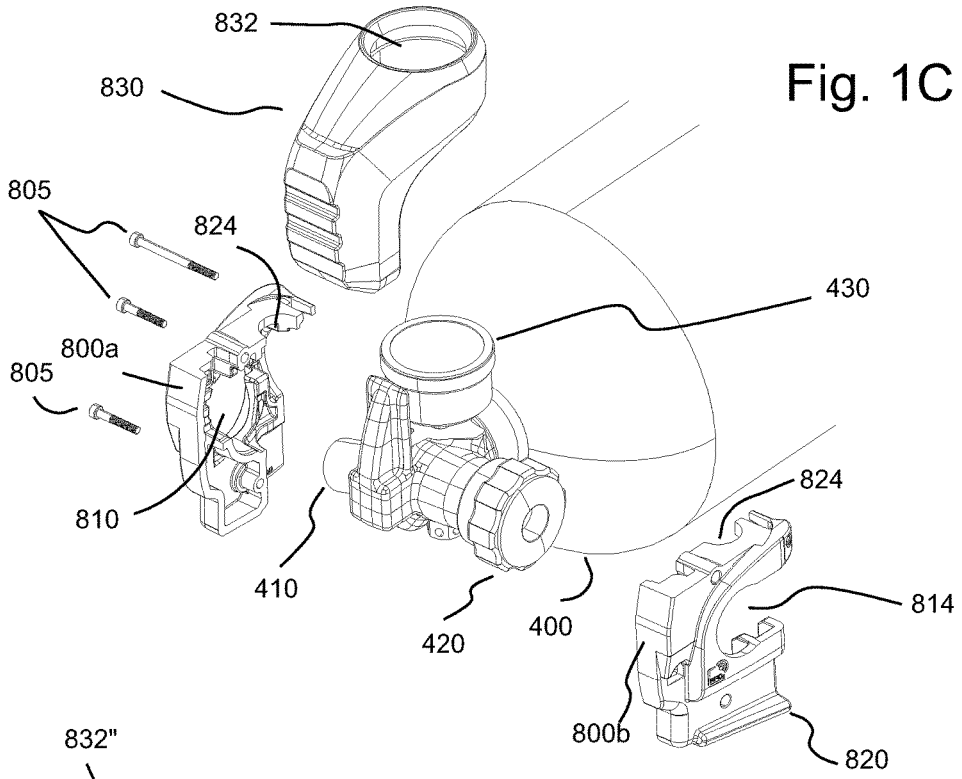
FIG. 1C illustrates a perspective, exploded view of one of the three tank brackets of FIG. 1B.
Figure 1D:
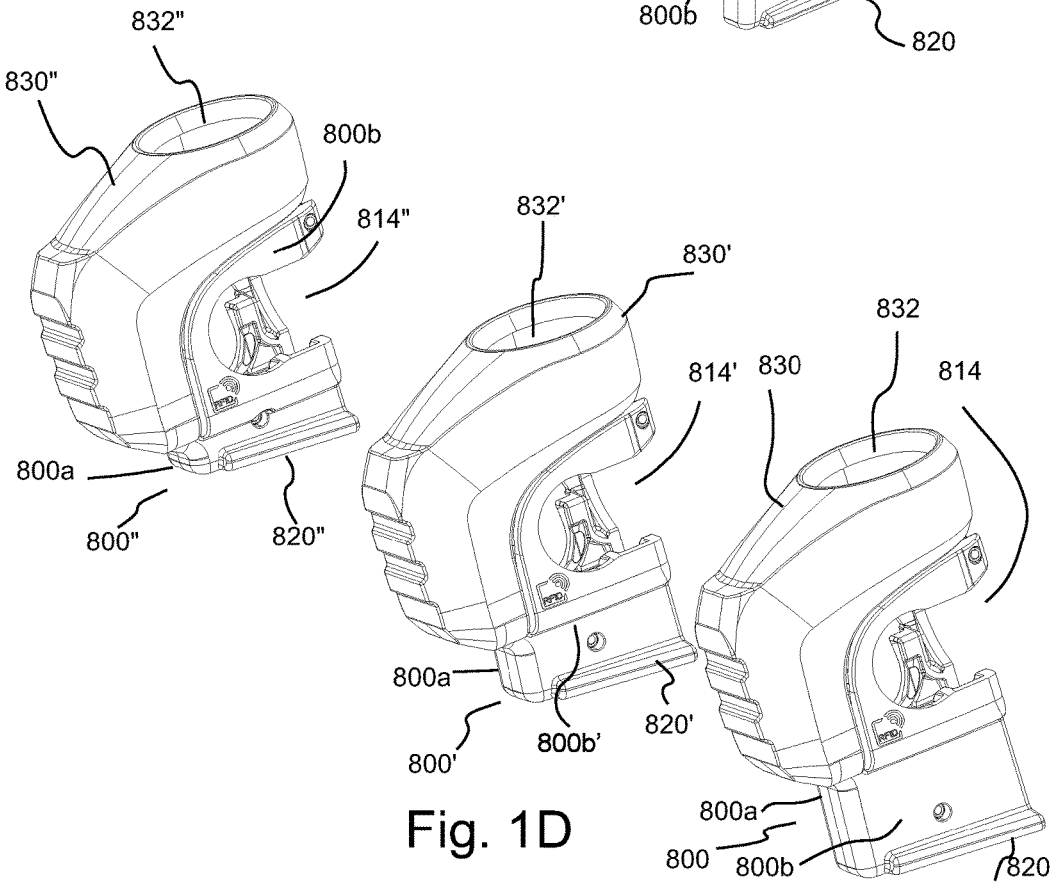
FIG. 1D illustrates perspective view of the three tank brackets of FIG. 1B in an assembled state and including a protective enclosure or covering for protecting the pressure gauges of the tanks.
Figure 2A:
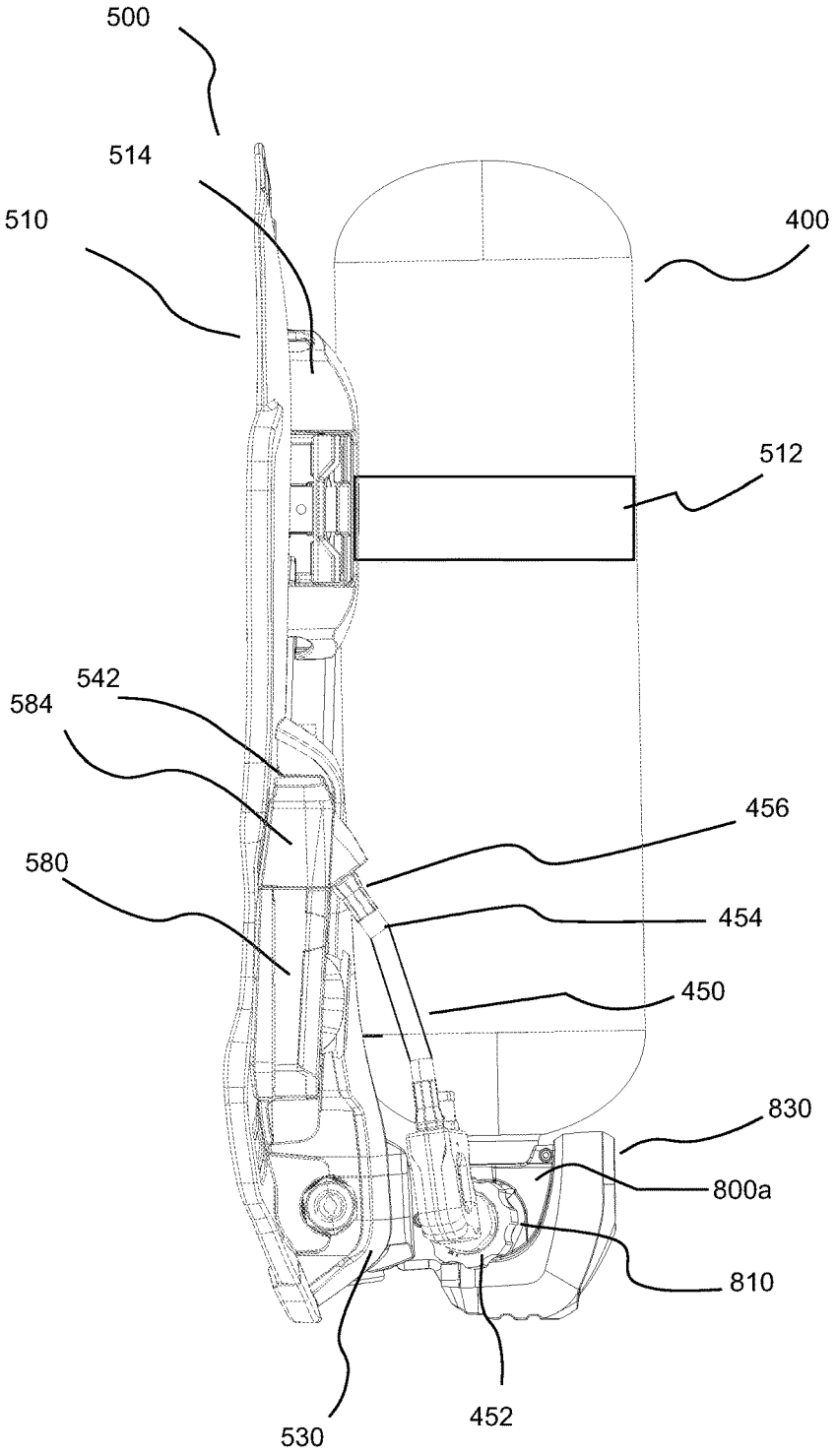
FIG. 2A illustrates a side view of the backplate of FIG. 1 with a tank attached thereto.
Figure 2B:
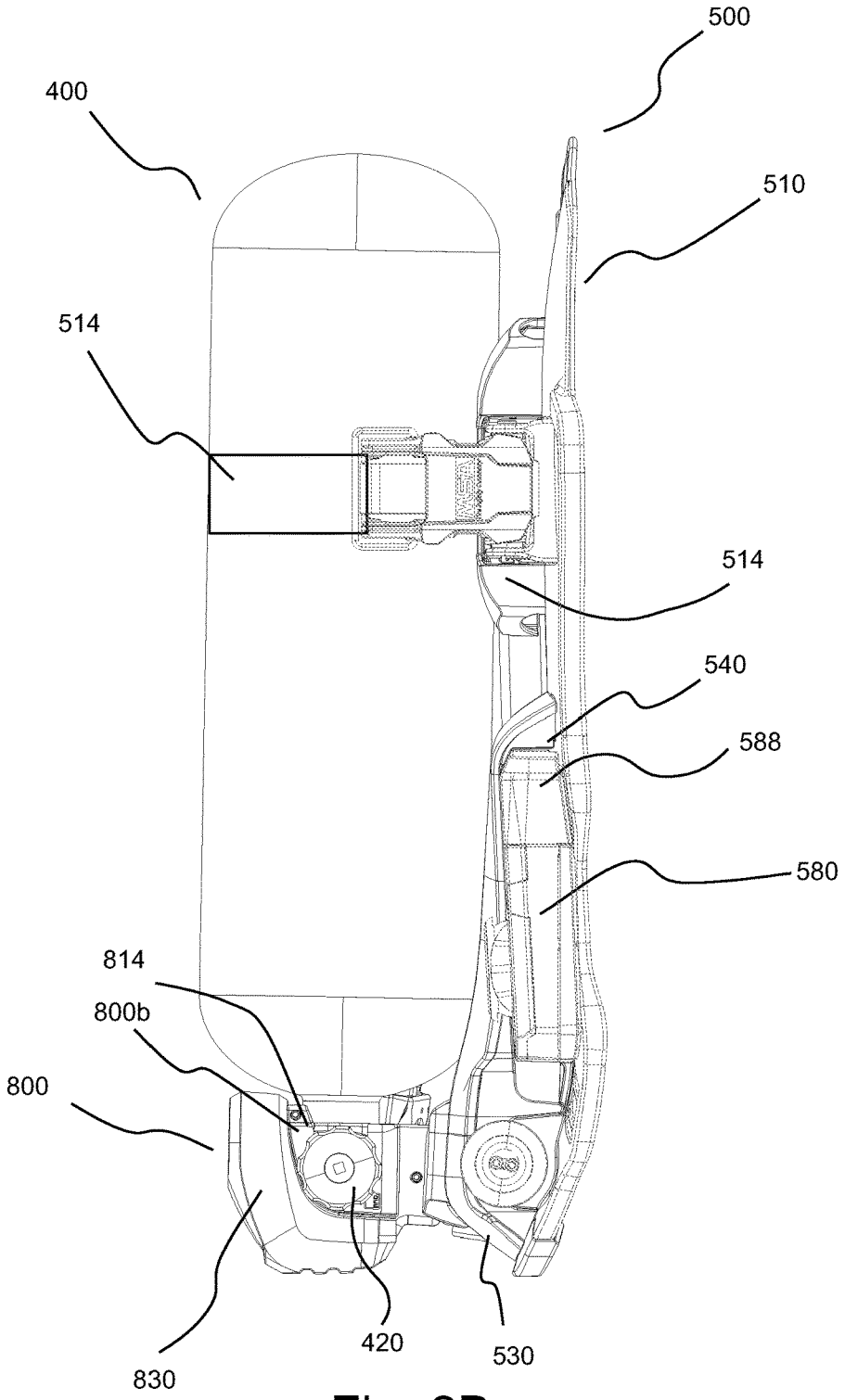
FIG. 2B illustrates a side view of the backplate of FIG. 1 with a tank attached thereto which is opposite the side view of FIG. 2A.
Figure 3A:
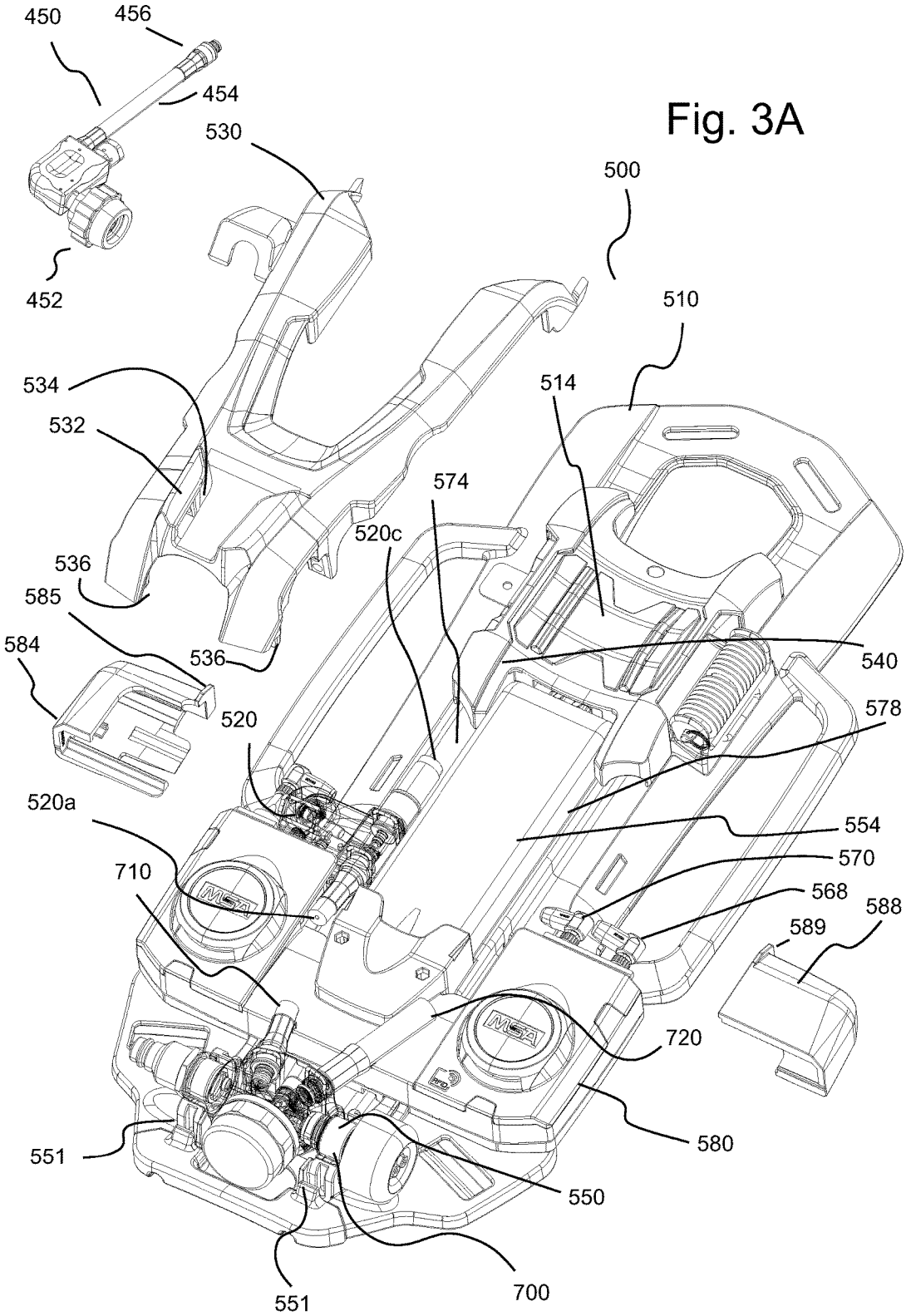
FIG. 3A illustrates a perspective view of the backplate of FIG. 1 in an exploded or disassembled state.
Figure 3B:
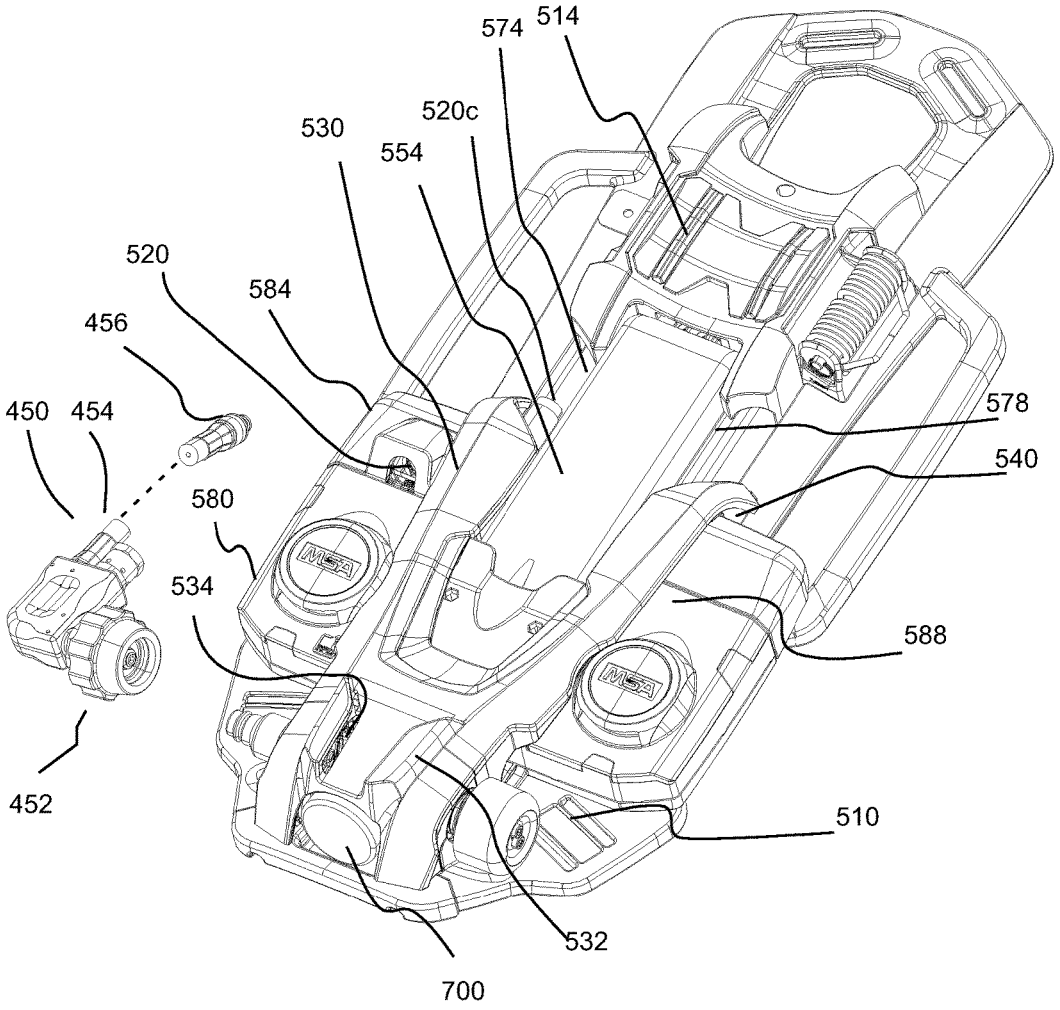
FIG. 3B illustrates a perspective view of the backplate of FIG. 1 in an assembled state.

In FIGS. 1A and 1B, three differently sized tanks including tank 400 (the largest tank), tank 400' (an intermediate sized tank) and tank 400" (the smallest tank) are illustrated (via a hidden line or transparent view) in an assembly with associated brackets 800, 800' and 800", which is connected with backplate 510. Reference numerals for a number of elements have been omitted from the lower portion of system 10 of FIG. 1A to avoid overcrowding and confusion. Such reference numerals are set forth in the enlarged view of the lower portion of system 10 set forth in FIG. 1B.

As described above, in a number of embodiments hereof, the tank retention system includes adjustable tank strap 512 and cooperating cradle 514. The tank retention system further includes a tank bracket which cooperates with the valve end of the tank to control the tank position in the x, y and z directions or axes (see, FIG. 1B) relevant to the carrier system. In FIG. 1B, the x axis corresponds generally to a vertical direction when carrier system 500 is worn by the user, while axis y corresponds generally to a horizontal, forward or rearward direction. The z axis, which is perpendicular to the plane of the drawing, corresponds generally to a horizontal, lateral direction. As described above, each tank has an associated bracket that is uniquely designed to position the tank (given that tank's size and/or geometry) in at least the x and y directions or axes so that, for example, the tank remains generally parallel to the general orientation of backplate 510 and so that a distance between connector 520 and the axis of the tank valve outlet is maintained substantially constant for each tank.

In the illustrated embodiment, a bracket 800 is used in connection with tank 400, a bracket 800' is used in connection with tank 400' and a bracket 800" is used in connection with tank 400". In general, brackets 800, 800' and 800" are similar in construction and operation. However, the geometries of brackets 800, 800' and 800" differ to, for example, maintain tanks 400, 400' and 400", respectively, parallel to backplate 510 and to maintain distances D1, D2 and D3 (see FIG. 1B) approximately equal. Distance D1, D2 and D3 are the distances between connector 520 and the axis of tank valve outlet 410, 410' and 410" of tank 400, 400' and 400", respectively.

In the illustrated embodiment, a distance (measured in the y direction of FIG. 1B) from a forward end of the bracket (that is, the end closest to backplate 510 during use) to an opening in the bracket through which the tank valve outlet extends increases as the diameter of the tank/cylinder diameter increases. The tank valve outlet is thus maintained at a more rearward position (that is, further away from backplate 510 along axis y in FIG. 5B) as the tank/cylinder diameter increases, while the tank is maintained generally parallel to and in contact with backplate 510. Moreover, as the tank/cylinder diameter increases, the bracket maintains the tank valve outlet in a higher or more upward vertical position (that is, to the left along axis x in FIG. 1B). In the illustrated embodiment, the result of the above-described positioning of the tanks along the x axis results in the axes of tank valve outlets 410, 410' and 410" ideally following a generally circular arc A having a center of radius at the axial end of connector 520 as illustrated in FIG. 1B. In such an embodiment, D1, D2, D3 . . . Dn (for a system designed for use with n tanks, wherein n is an integer greater than 3) would all be equal and would correspond to the radius of the circular arc.

In actual use, arc A need not be perfectly circular and distances D1, D2, D3 . . . Dn are preferably substantially equal. In a number of embodiments, distances D1, D2, D3 . . . Dn vary or differ over a range of no more than 0.5 inches (0.01270 meters), no more 0.25 inches (0.00635 meters) or even no more than 0.1 inches (0.00254 meters).

In the illustrated embodiment, the positioning of the tanks in the x direction is accomplished via the cooperation of a connector 532 of backplate 510 with a cooperating connector at the forward end of each bracket. Connector 820 of bracket 800 is, for example, illustrated in FIGS. 1C and 1D. In the illustrated embodiment, connector 532 includes or defines a dovetailed channel or slot 534 (that is, a female dovetailed connection) and the cooperating connector 820 is a dovetailed flange or flanges (that is, male dovetailed connection). The geometry of dovetailed cooperating connector (for example, the angle of flare thereof) is readily predetermined for a particular bracket to position the tank associated with that bracket at the desired position along the x axis as described above. As clear to one skilled in the art, other cooperating connector geometries or an adjustable connector to which the brackets are attached can be used. Static or non-adjustable connectors provide simplicity in manufacture and operation.

In preparing a tank/cylinder such as tank 400 for use in connection with system 10, a bracket such as bracket 800 is first placed in connection with tank 400 to form an assembly as described above. In the illustrated embodiment, representative bracket 800 comprises two separable sections or members 800*a* and 800*b* (formed, for example, from a metal). Opening 810 is formed in section 800*a* for passage of valve 410 therethrough. An opening 814 is formed in section 800*b* for passage of tank control knob 420 therethrough. Sections 800*a* and 800*b* are brought together to encompass the lower end of tank 400 as described above and then attached using connector or fasteners such as screws 805 to capture the lower end of tank 400. Sections 800*a* and 800*b* include openings or seating 824 to encompass pressure gauge 430 of tank 400 when bracket 800 is connected to tank 800. In a number of embodiments a protective component or enclosure such as a rubberized boot or enclosure 830 is attached to section 800*a* and section 800*b* after connection thereof to capture the lower end of tank 400 to, for example, provide protection for a pressure gauge 430 of tank 400. An opening 832 in enclosure 830 can be provided to enable viewing of gauge 430 (see, for example, FIGS. 1C, 1D and 5A) when enclosure 830 is in place. As clear to one skilled in the art, brackets are readily formed as described herein to cooperate with and attach to generally any tank design and geometry. Like components of brackets 800' and 800" are number similarly to the corresponding components of bracket 800 with the addition of the designation "'" and "'" thereto.

Once bracket 800 is installed on tank 400, the assembly including tank 400 and bracket 800 may be placed in operative connection with backplate 510. In that regard, the assembly is positioned with cooperating connector 820 of bracket 800 aligned with connector 532. The assembly is then slid downward to bring the dovetailed flange(s) of cooperating connector 820 into abutting connection with dovetailed slot or channel 534 of connector 532 (thereby, fixing the position of tank 400 in the x, y and z directions). Tank strap 512 is then securely tightened around tank 400 via a latching mechanism 514 as known in the art.

In the illustrated embodiment, hose assembly 450 includes, for example, a threaded handwheel 452 which is connected to tank valve outlet 410 via cooperating threading as known in the art. Hose assembly 450 further includes a length of high-pressure hosing 454 having a cooperating connector 456 (for example, a high-pressure, cooperating quick coupler) to form a cooperating fluid connection with connector 520 (for example, a high-pressure quick coupler). As described above, hose assembly 450 can be used in connection with any one of tanks 400, 400' and 400" (as well as other tanks) as a result of the tank positioning retention system and methodology discussed above.

Figure 4:
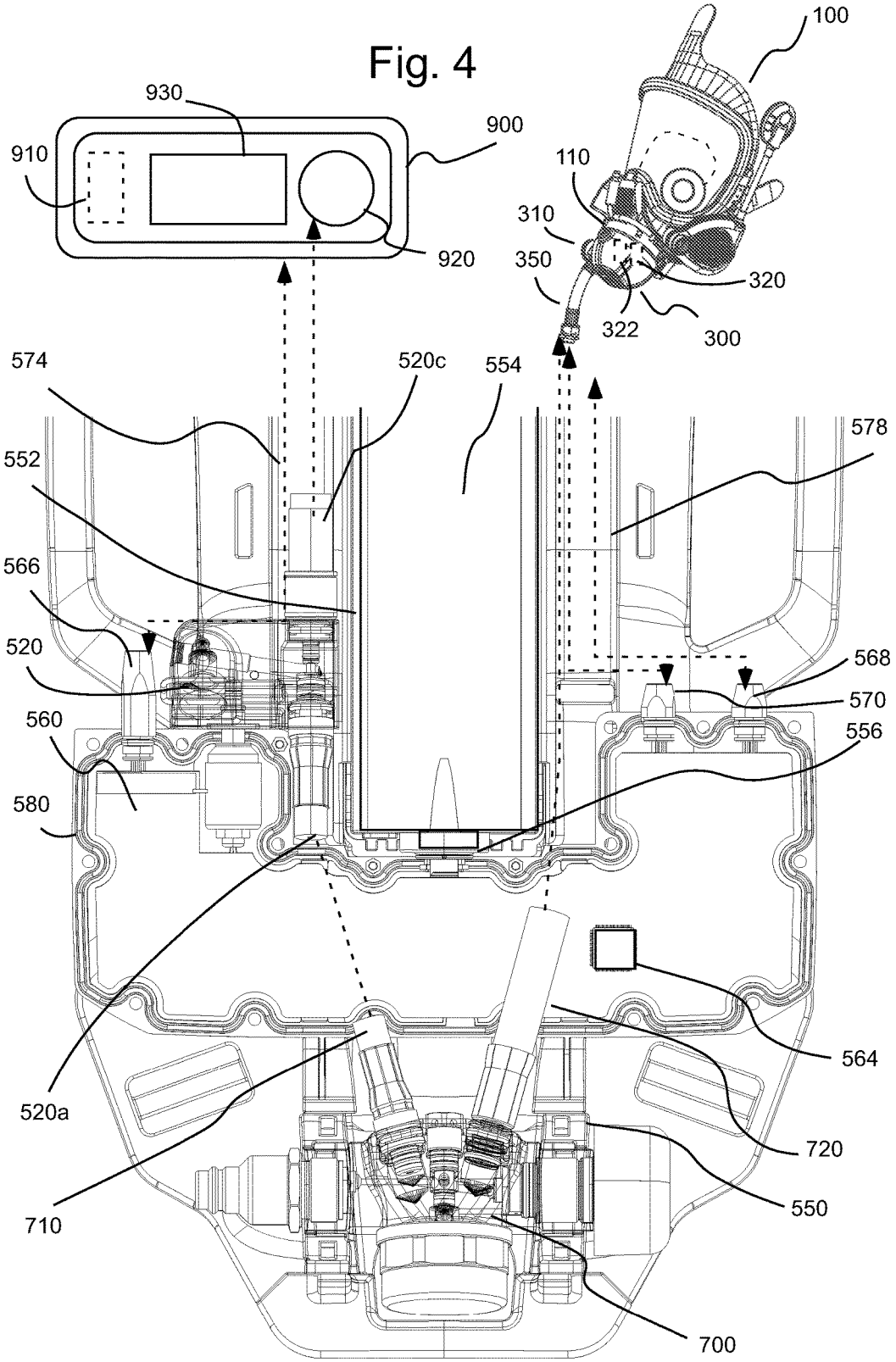
FIG. 4 illustrates a cutaway view of a portion of a backplate of the carrier system of FIG. 1 including electronic circuitry.
Figure 5A:
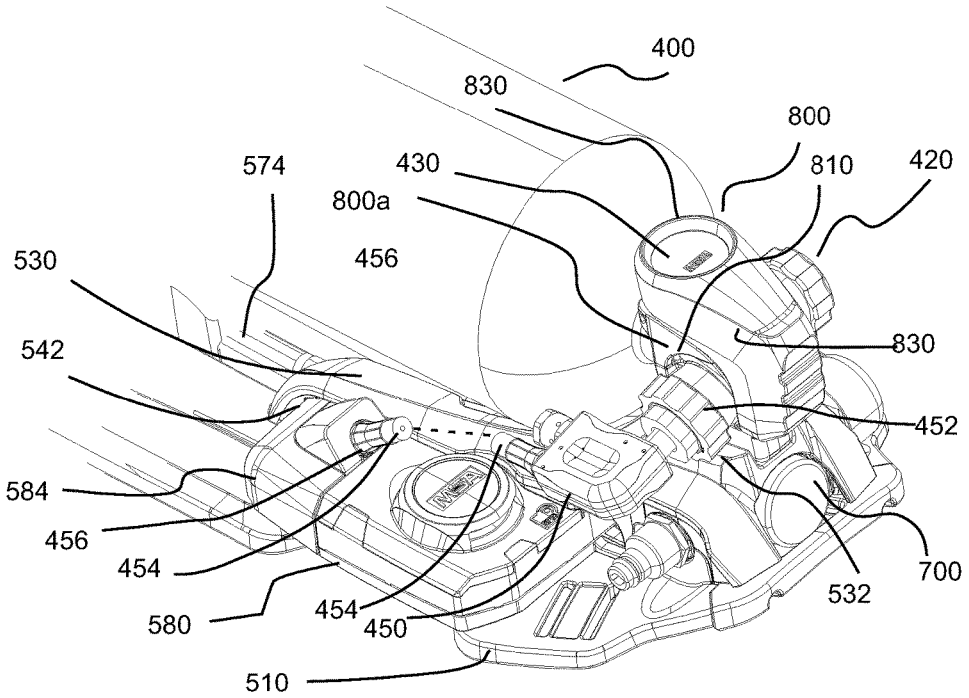
FIG. 5A illustrates a perspective view of a lower portion of the backplate with a tank in operative connection therewith.
Figure 5B:
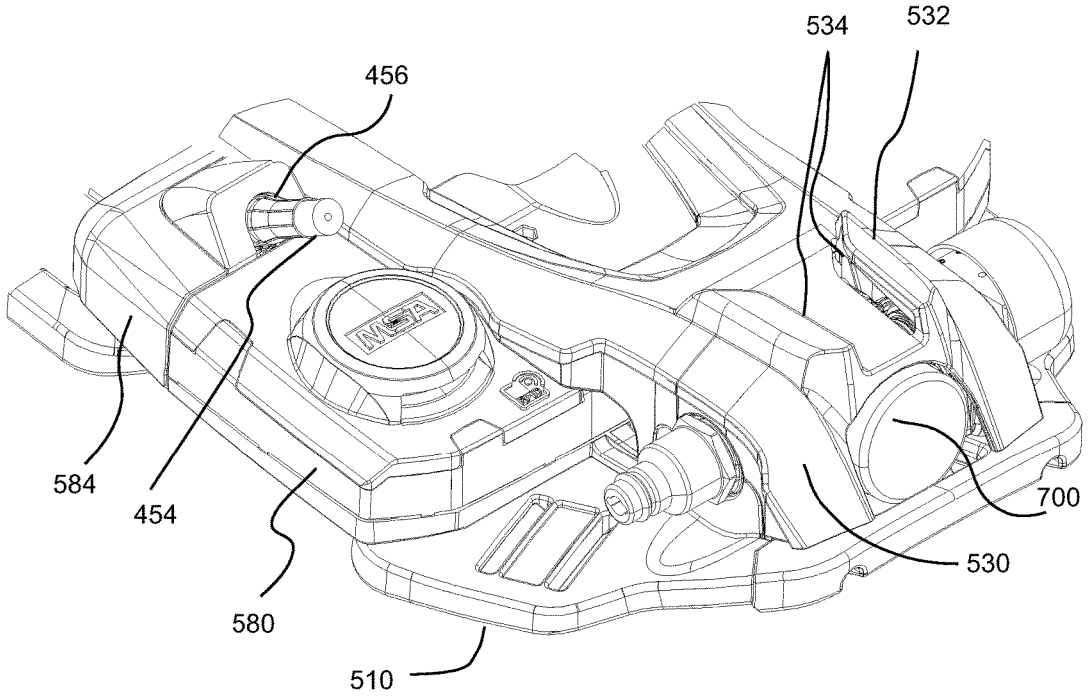
FIG. 5B illustrates a perspective view of the lower portion of the backplate of FIG. 5A without a tank in operative connection therewith.
Figure 6A:
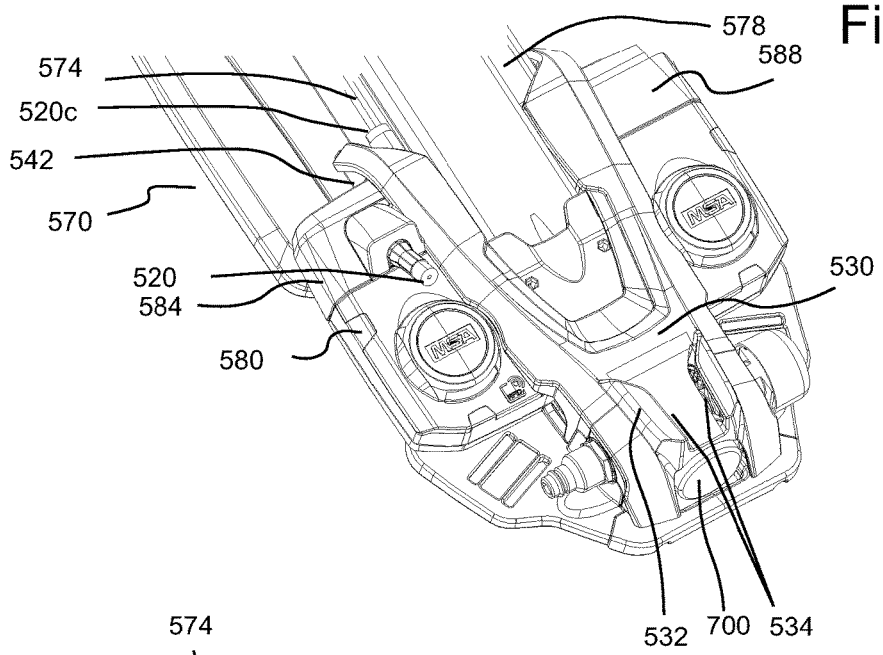
FIG. 6A illustrates another perspective view of a lower portion of the backplate.
Figure 6B:
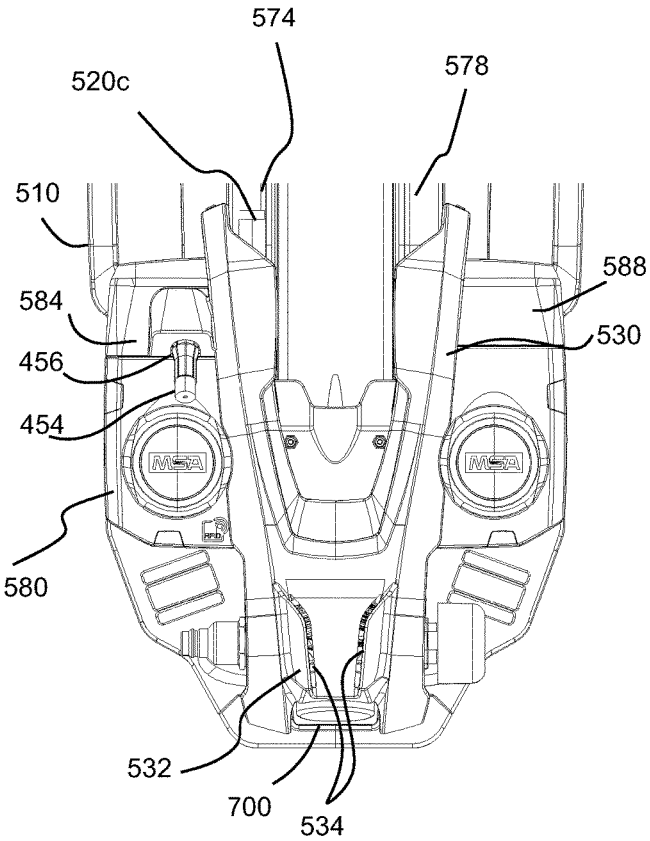
FIG. 6B illustrates a top view of a lower portion of the backplate.
Figure 6C:
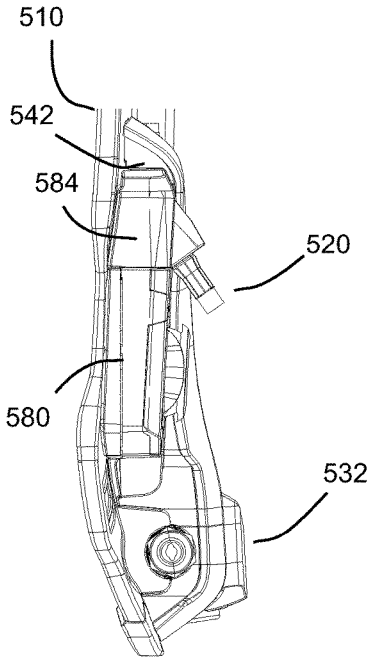
FIG. 6C illustrates a side view of a lower portion the backplate.
Figure 7A:
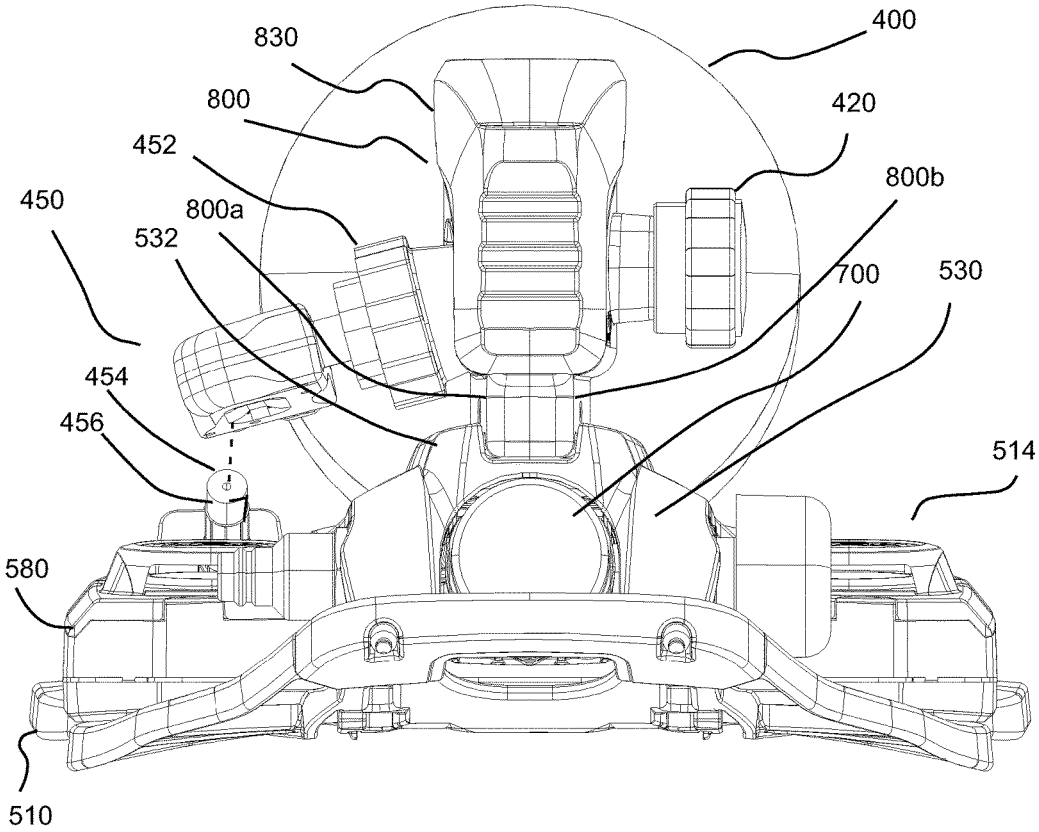
FIG. 7A illustrates a bottom view of the backplate with a tank in operative connection therewith.
Figure 7B:
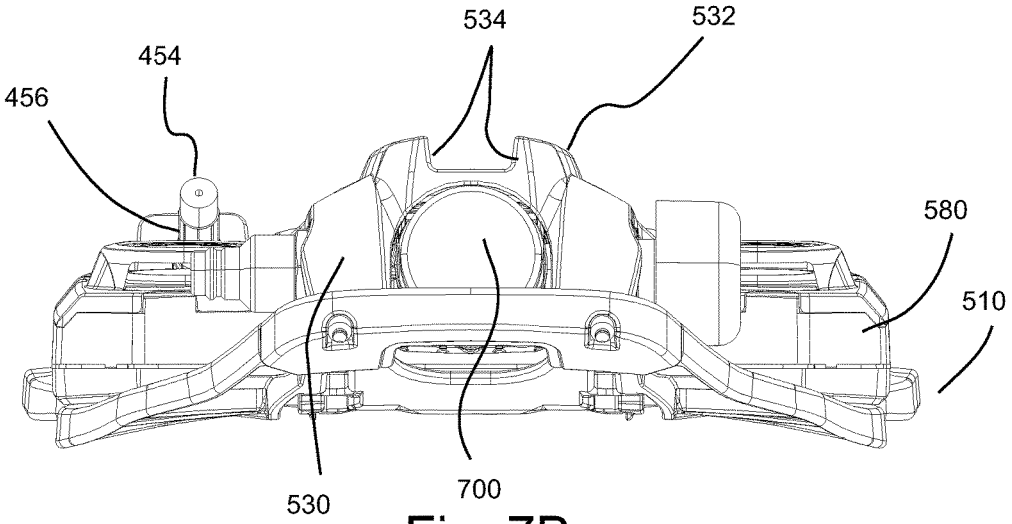
FIG. 7B illustrates a bottom view of the backplate without a tank in operative connection therewith.

As, for example, illustrated in FIG. 4, backplate 510 of breathing apparatus 10 includes a connection assembly or system 550 that connects to and positions first stage regulator assembly 700 at a lower end of backplate 510. Backplate 510 further includes or has attached thereto a generally centrally located power compartment 552 into which a power source 554 including, for example, one or more batteries is assembled. Power source 554 is, for example, in electrical connection (for example, via connector(s) 556) with an electronics system including, for example, a printed circuit board 560, which (in the illustrated embodiment) is positioned between power compartment 552 and first stage regulator 700. Printed circuit board 560 includes electrical components and control components (including, for example, one or more processors 564 such as one or more microprocessors).

A number of electrical connections extend from printed circuit board 560. For example, an electrical connection or connections 566 connects printed circuit board 560 with a control module 900 via intermediate cabling. Control module 900 may, for example, include a Personal Alert Safety System or PASS 910 as, for example, described in U.S. Pat. No. 6,198,396, to provide an alarm in the case of lack of movement of the user. Control module 900 may, for example, further include an analog pressure gauge 920 to provide the user with a visual reading of the pressure within tank 400 and one or more displays 930 for providing other information, alerts etc. Analog pressure gauge 920 is in fluid connection with connector 520 (and thereby with tank 400 or other tank connected to connector 520) via a connector 520*c* in fluid connection with connector 520.

An electrical connection 568 connects printed circuit board 560 to, for example, a voice amplifier via intermediate cabling. Similarly, an electrical connection or connections 568 connects printed circuit board 560 to, for example, a microphone 320 and a heads up display (HUD) components 322 (which are illustrated schematically in FIG. 4) incorporated in second stage regulator 300 via intermediate cabling. Such a microphone and a HUD are, for example, described in U.S. Patent Application Publication No. 2012/0152253.

In a number of embodiments, carrier system 500 includes channels or guide paths for guiding or directing pneumatic hosing and cabling/wiring. Such channels or guide paths may, for example, be formed in backplate 510 or be formed (at least in part) from components attached to backplate 510. For example, hosing from connector 520*c* passes through a channel or guide path 574 to control module 900. Likewise, cabling from electrical connection 566 passes through guide path 574 to control module 900. Similarly, hosing connecting first stage pressure assembly connector 720 to hosing 350 (which is in fluid connection with second stage pressure regulator 300) passes through or along a guide path 578. Cabling or wiring from electrical connections 568 and 570 also passes through or along guide path 578. Guide paths 574 and 578 may for example, pass through or under cradle assembly 514 (which assists in protecting, guiding and retaining components passing through guide paths 574 and 578). Such guide paths assist in directing and organizing hosing and cabling and facilitate protection thereof as further described below. As, for example, illustrated FIG. 3A, printed circuit board 560 is enclosed within a electronics housing assembly 580, which extend laterally across the width of backplate 510 between first stage pressure regulator 700 and power source 554, from which electrical connections 566, 568 and 570 extend.

In a number of embodiments, carrier system 500 further includes a cover or enclosure system including one or more covers such as outer cover 530 (as describe above) which is attachable to backplate 510 to protect and/or retain components such as pneumatic and/or electronic components (for example, connectors, hoses, cables etc.). Backplate 510 also includes features that interface with the cover or enclosure system. In the illustrated embodiment, a first side cover or enclosure 584 covers the cabling connected to connector 566 as that cabling is directed (for example, with the assistance of first side cover 584) into guide path 574 on a first side of backplate 510. A second side cover or enclosure 588 covers cabling connected to connectors 568 and 570 as that cabling is directed (for example, with the assistance of second side cover 588) into guide path 574 on a second side of backplate 510. First side cover 584 slides into connection with an upper portion of electronics housing assembly 580 on a first (or left) side thereof, and second side enclosure 588 slides into connection with an upper portion of electronics housing assembly 580 on a second (or right side thereof).

In the illustrated embodiment, outer or rearward cover or enclosure 530 attaches to back plate 510 to cover or enclose (as well as retain) pneumatic and electrical components as described above (for example, at least a portion of first stage regulator 700, electronics assembly housing 580, power source 554, and pneumatic and/or electrical components passing through guide paths 574 and 578). In the illustrated embodiment, outer cover 530 includes fasteners 536 that cooperate with cooperating fasteners 551 (positioned below first stage pressure regulator 700) in, for example, a simple hooking and hinging fashion. Outer cover 530 extends over at least a portion of first stage regulator assembly 700 and electronics housing assembly 680 to, for example, assist in retaining, and protecting first stage regulator assembly 700 and electronic housing assembly 580. Outer cover 530 also encompasses and protects connectors 520*a*, 520*c*, 710 and 720. Outer cover may, for example, include features or components that cooperate with and retain side covers or enclosure 584 and 588 to secure such covers in place.

When breathing apparatus 10 is assembled, first stage regulator assembly 700, the electronics system or assembly (including, for example, printed circuit board 560, connections 566, 568 and 570, and electronics assembly housing 580), and power source 554 are positioned on back plate 510. Subsequently, pneumatic and electrical connections as described above are made. Thereafter, first and second side covers 584 and 588, respectively are slid into place. Outer cover 530 is then hooked into back plate 510 (via fasteners 536 and cooperating fasteners 551), and outer cover 530 is hinged forward. As described above, features on outer cover 530 may, for example, interlock with first and second side covers 584 and 588, respectively. In the illustrated embodiment, flanges 540 and 542 formed on outer cover 530 abut and cooperate with flanges 585 and 589 on first side cover 584 and second side cover 588, respectively. As a result, first and second side covers 584 and 588 are secured in connection with backplate 510. When outer cover 530 is hinged into a securing position, it may, for example, be retained with a connector (for example, a screw—not shown) attached to an upper portion of outer cover 530 on each side thereof.

In the illustrated embodiment, outer cover 530 includes connector 532 as described above for attachment of tank/cylinder brackets (such as tank bracket 800) thereto. Outer cover 530 and other components of carrier system 500 may, for example, be molded (for example, integrally molded) from a polymeric material.

Using protective covers such as side cover 584 and 588 and outer cover 530 provides the ability to expand material options to, for example, facilitate weight reduction as compared to systems in which pneumatic and/or electrical components are exposed. For example, aluminum may be substituted for brass in a number of components. As discussed above, currently available breathing apparatuses with remote tank connections, use a plurality of connectors to position and attach pneumatic and electrical components to the backplate. Using a single component such as outer cover 530 to cover and retain at least a portion of the pneumatics and/or electronics components, and also to (optionally) position and attach the tank significantly simplifies the breathing apparatus design and associated manufacturing and service operations. The assembly and removal of pneumatics and/or electronics components is significantly facilitated by the cover system hereof.

The positioning of first stage pressure regulator 700 and electronics assembly housing 580 at the bottom of backplate 510 and the routing of pneumatic hosing/conduits and electronic cabling/wiring toward the center of backplate 510 and upward facilitates the protection and retention thereof by a single outer cover 530 which overlays the lower, central components of the SCBA system 10. As described above, the assembly forming cradle 514 can further assist in protecting and retaining pneumatic hosing/conduits and electronic cabling/wiring on an upper portion of backplate 510.

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. A system, comprising:

a carrier system adapted to be worn by a user and comprising a rigid backplate to support at least one of a plurality of tanks of pressurized breathing gas having different tank diameters, each of the plurality of tanks comprising a tank valve at an end thereof, the tank valve having an outlet, at least one pressure regulator attached to the carrier system and a connector attached to the carrier system which is in fluid connection with the at least one pressure regulator;

a bracket connector attached to the rigid backplate of the carrier system; and a plurality of brackets, each of the plurality of brackets having a different configuration, each of the plurality of brackets being attachable to an associated one of the plurality of tanks prior to attachment of an assembly comprising one of the plurality of brackets and the associated one of the plurality of tanks to the carrier system to capture at least a portion of the tank valve thereof and being severally and removably attachable to the bracket connector, wherein, for each one of the plurality of brackets, the assembly comprising the one of the plurality of brackets and the associated one of the plurality of tanks, when attached to the bracket connector, positions the associated one of the plurality of tanks adjacent the rigid backplate and positions the outlet of the tank valve of the associated one of the plurality of tanks of the assembly at a unique predetermined rearward position relative to the carrier system and at a unique predetermined vertical position relative to the carrier system, wherein the unique predetermined rearward position of the tank valve outlet relative to the carrier system and the unique predetermined vertical position of the tank valve outlet relative to the carrier system for each of the plurality of tanks coincides generally with a predetermined arc so that a distance between the tank valve outlet of the associated one of the plurality of tanks and the connector varies by less than 0.5 inches.

2. The system of claim 1 wherein the associated one of the plurality of tanks of the assembly is also positioned at a predetermined angle relative to the rigid backplate when the assembly is attached to the bracket connector.

3. The system of claim 2 wherein the associated one of the plurality of tanks of the assembly is positioned generally parallel to a portion of the rigid backplate regardless of which of the plurality of tanks is connected to the assembly when the assembly is attached to the bracket connector.

4. The system of claim 1 wherein the bracket connector is a dovetailed connector and each one of the plurality of brackets comprises a cooperating dovetailed connector.

5. The system of claim 1 wherein the predetermined distance is less than 0.25 inches.

6. The system of claim 1 further comprising a hose assembly having a fixed length and comprising a cooperating connector adapted to attach to the connector and a tank valve connector adapted to attach to the tank valve outlet to place the tank valve outlet in fluid connection with the at least one pressure regulator regardless of which one of the plurality of tanks is connected to the assembly when the assembly is attached to the bracket connector.

7. The system of claim 1 wherein the carrier system comprises a rigid back plate to which the at least one pressure regulator, the connector and the bracket connector are attached.

8. The system of claim 7 wherein the associated one of the plurality of tanks of the assembly is generally parallel to a portion of the rigid back plate regardless of which of the plurality of tanks is connected to the assembly when the assembly is attached to the bracket connector.

9. The system of claim 8 wherein each of the plurality of tanks of the assembly is generally cylindrical over a portion of the length thereof.

10. The system of claim 1 wherein the bracket connector and each one of the plurality of brackets cooperates to fix a rearward position of the tank valve outlet of the associated one of the plurality of tanks relative to the carrier system and to fix a height of the of the tank valve outlet of the associated one of the plurality of tanks relative to the carrier system.

11. The system of claim 10 wherein the fixed rearward position of the tank valve outlet of the associated one of the plurality of tanks relative to the carrier system and the fixed height of the tank valve outlet of the associated one of the plurality of tanks relative to the carrier system coincides generally with a predetermined arc about the connector for each of the plurality of tanks.

12. The system of claim 1 wherein the bracket connector is a dovetailed connector and each one of the plurality of brackets comprises a cooperating dovetailed connector.

13. The system of claim 11 wherein the bracket connector is a dovetailed connector and each one of the plurality of brackets comprises a cooperating dovetailed connector.

14. The system of claim 1 wherein each one of the plurality of brackets comprises a first section and a second section that is removably attachable to the first section, wherein each one of the plurality of brackets is attachable to the associated one of the plurality of tanks by attaching the first section to the second section to capture a portion of the associated one of the plurality of tanks so that the tank valve extends between the first section and the second section.

15. The system of claim 3 wherein the carrier system further comprises an arced cradle to contact the associated one of the tanks and a tank strap to extend around a portion of the associated one of the tanks, and the associated one of the plurality of tanks of the assembly is positioned generally parallel to the cradle regardless of which of the plurality of tanks is connected to the assembly when the assembly is attached to the bracket connector.

16. The system of claim 1 further comprising a cover system releasably attachable to the carrier system, the cover system encompassing at least a portion of a pneumatic hose in fluid connection with the pressure regulator.

17. The system of claim 16 wherein the carrier system further comprises an electronics system comprising at least one electronic cable, the cover system encompassing at least a portion of the at least one electronic cable.

18. A method of providing for attachment of one of a plurality of tanks of pressurized breathing gas having different diameters and comprising a tank valve to a rigid backplate of a carrier system to be worn by a user, comprising:

providing a plurality of brackets, each of the plurality of brackets having a different configuration, each of the plurality of brackets being attachable to an associated one of the plurality of tanks to encompass at least a portion of the tank valve thereof prior to attachment of an assembly comprising one of the plurality of brackets and the associated one of the plurality of tanks to the carrier system and being severally and removably attachable to a bracket connector of the rigid backplate of the carrier system, wherein, for each one of the plurality of brackets, the assembly comprising the one of the plurality of brackets and the associated one of the plurality of tanks, when attached to the bracket connector of the carrier system, positions the associated one of the plurality of tanks in a predetermined position relative to the carrier system and positions the outlet of the tank valve of the associated one of the plurality of tanks of the assembly at a unique predetermined rearward position relative to the carrier system and at a unique predetermined vertical position relative to the carrier system, wherein the unique predetermined rearward position of the tank valve outlet relative to the carrier system and the unique predetermined vertical position of the tank valve outlet relative to the carrier system for each of the plurality of tanks coincides generally with a predetermined arc so that a distance between the tank valve outlet of the associated one of the plurality of tanks and the connector varies by less than 0.5 inches.

* * * * *